US005526647A

United States Patent [19]

Grenier

[11] Patent Number: 5,526,647

[45] Date of Patent: Jun. 18, 1996

[54] PROCESS AND INSTALLATION FOR THE PRODUCTION OF GASEOUS OXYGEN UNDER PRESSURE AT A VARIABLE FLOW RATE

[75] Inventor: Maurice Grenier, Paris, France

[73] Assignee: L'Air Liquide, Societe Anonyme Pour L'Etude Et L'Exploitation Des Procedes Georges Claude, Paris Cedex, France

[21] Appl. No.: 424,633

[22] Filed: Apr. 19, 1995

[30] Foreign Application Priority Data

Jul. 29, 1994 [FR] France ..... 94 09481

[51] Int. Cl.[6] ..... F25J 3/00

[52] U.S. Cl. ..... 62/654; 62/913

[58] Field of Search ..... 62/11, 13, 21, 62/22, 24, 37, 40, 41

[56] References Cited

U.S. PATENT DOCUMENTS

| | | | |
|---|---|---|---|
| 3,059,439 | 10/1962 | First et al. | 62/41 X |
| 3,174,293 | 3/1965 | Jakob et al. | 62/41 X |
| 4,133,662 | 1/1979 | Wagner | 62/13 |
| 4,529,425 | 7/1985 | McNeil | 62/37 |
| 4,732,595 | 3/1988 | Yoshino | 62/11 |
| 4,962,646 | 10/1990 | Rathbone | 62/24 |
| 5,082,482 | 1/1992 | Darredeau | 62/41 X |
| 5,084,081 | 1/1992 | Rohde | 62/22 |
| 5,265,429 | 11/1993 | Dray | 62/41 |
| 5,329,776 | 7/1994 | Grenier | 62/41 X |
| 5,408,831 | 4/1995 | Guillard et al. | 62/40 X |

FOREIGN PATENT DOCUMENTS

| | | |
|---|---|---|
| 383884 | 9/1987 | Austria . |
| 2685460 | 6/1993 | France . |
| 2-293575 | 12/1990 | Japan . |
| 6-011254 | 1/1994 | Japan . |

*Primary Examiner*—Christopher Kilner
*Attorney, Agent, or Firm*—Young & Thompson

[57] ABSTRACT

In a process for the production of gaseous oxygen under pressure at a variable flow rate, of the type in which air is distilled in an air distillation installation comprising a distillation apparatus (7) and a heat exchange line (6) to cool the air by heat exchange with the products from the distillation apparatus; liquid oxygen is withdrawn from this apparatus, brought to a vaporization pressure, vaporized and reheated under this pressure in the heat exchange line, this vaporization and this reheating being accompanied by a liquefaction of air in the air liquefaction passages (21; 21,21A) of the heat exchange line. During a reduction of the demand for gaseous oxygen under pressure, relative to the nominal flow rate, excess oxygen produced by the distillation apparatus is withdrawn from this apparatus, in liquid phase, sent to a receptacle (11) for the storage of liquid oxygen, and there is introduced into the distillation apparatus (7) a previously stored (in 13) corresponding additional quantity of liquid air; and during an increase in the demand for gaseous oxygen under pressure relative to the nominal flow rate, the required excess oxygen is withdrawn, in liquid phase, from the liquid oxygen storage receptacle (11), brought (in 12) to the vaporization pressure, and vaporized under this pressure (in 18) in the heat exchange line (6), and there is stored a corresponding quantity of air liquefied by said vaporization, in the liquid air storage receptacle. The liquid oxygen is stored under a pressure in the neighborhood of atmospheric pressure, while the liquid air is stored under a storage pressure substantially greater than the highest operating pressure of the distillation apparatus.

6 Claims, 2 Drawing Sheets

Figure 1:
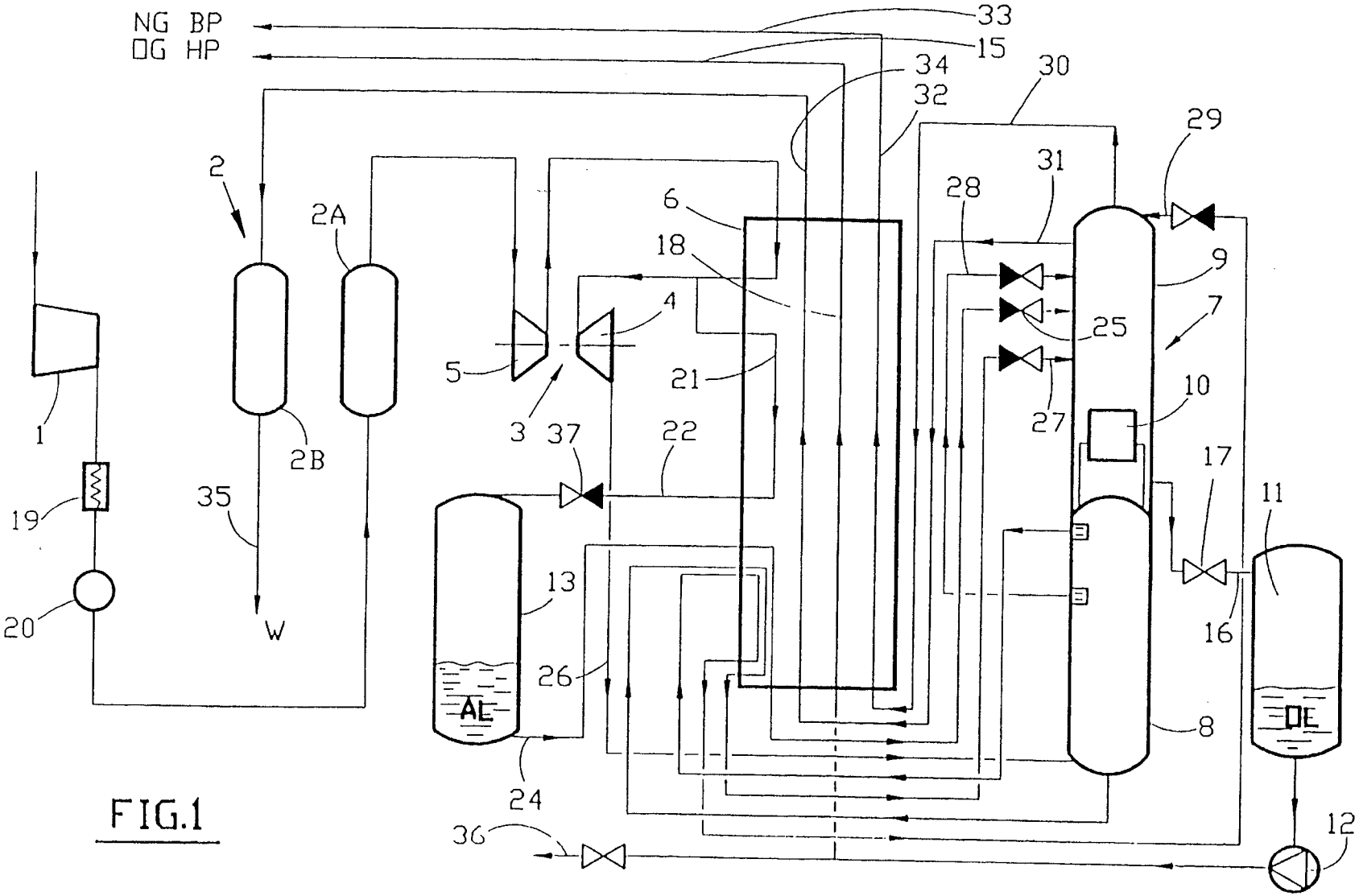

PROCESS AND INSTALLATION FOR THE PRODUCTION OF GASEOUS OXYGEN UNDER PRESSURE AT A VARIABLE FLOW RATE

The present invention relates to a process for the production of gaseous oxygen under pressure at variable flow rate, of the type in which the air is distilled in an air distillation installation comprising a distillation apparatus and a heat exchange line to cool the air by heat exchange with products from the distillation apparatus; liquid oxygen is withdrawn from this apparatus, brought to a vaporization pressure, vaporized and reheated under this pressure in the heat exchange line, this vaporization and this reheating being accompanied by a liquefaction of the air in the air liquefaction passages of the heat exchange line; and in which:

—during a reduction of demand for gaseous oxygen under pressure relative to the nominal flow rate, there is withdrawn from the distillation apparatus, in liquid phase, the excess liquid oxygen produced by this apparatus, this liquid oxygen is sent to a liquid oxygen storage receptacle, and there is introduced into the distillation apparatus an additional corresponding quantity of liquid air previously stored; and —during an increase in the demand for gaseous oxygen under pressure relative to the nominal flow rate, the required excess oxygen is withdrawn, in liquid phase, from the liquid oxygen storage receptacle, brought to the vaporization pressure, and vaporized under this pressure in the heat exchange line, and a corresponding quantity of air is stored which has been liquefied by said vaporization, in the liquid air storage receptacle.

In the present text, the indicated pressures are absolute pressures. Moreover, by "condensation" and "vaporization" are meant either a condensation or a vaporization as such, or a pseudo-condensation or a pseudo-vaporization, according to whether the pressures are subcritical or supercritical.

Processes of this type (see for example FR-A-1158639) are sometimes called "pumped processes with air-oxygen swing". The invention is applicable particularly to the so-called processes "with offset phase change isotherms", of which examples are described in French patent applications Nos. 91 02 917, 91 15 935, 92 02 462, 92 07 662 and 93 04 274. These processes, in which the liquefaction of the air is effected at a temperature below the vaporization temperature of oxygen under its vaporization pressure, have interesting advantages not only from the point of view of the capital cost of constructing the installation, but also from the point of view of specific energy consumption, which is to say the energy necessary to produce a given quantity of gaseous oxygen under pressure.

The invention has for its object to provide means permitting satisfying a variable demand of oxygen under pressure in a particularly simple way and without substantial impairment of performance, neither as to the thermal diagram, which is to say the equilibrium of the heat exchange line, nor as to that of the distillation of the air.

To this end, the invention has for its object a process of the mentioned type, characterized in that liquid oxygen is stored under a pressure near atmospheric pressure while liquid air is stored under storage pressure at least equal to, and preferably substantially higher than, the highest operating pressure of the distillation apparatus.

This process can comprise one or several of the following characteristics:

—the liquid air storage receptacle is at a pressure adjacent the pressure at which said liquefaction of air takes place;

—the liquid air storage receptacle is at a pressure comprised between about 30 and 35 bars;

—all the vaporized oxygen is withdrawn from the liquid oxygen storage receptacle;

—said liquefaction of air is effected at a temperature below the vaporization temperature of the oxygen under said vaporization pressure, and at least one liquid product is removed from the installation; and —the air destined for the liquid air storage receptacle is compressed to said storage pressure and the rest of the air to a high pressure above this storage pressure.

The invention also has for an object an installation for the production of gaseous oxygen under pressure at variable flow rate, adapted to practice the process defined above. This installation, of the type comprising: an air distillation apparatus; a heat exchange line to cool the air by heat exchange with products from the distillation apparatus; means to withdraw liquid oxygen from this apparatus; means to bring this liquid oxygen to a vaporization pressure and to send it through the oxygen vaporization passages of the heat exchange line; compression means adapted to bring at least one fraction of the air to be distilled to a high pressure, and to send it through the air liquefaction passages of the heat exchange line; a receptacle for the storage of liquid oxygen connected to the distillation apparatus and provided with means to withdraw liquid oxygen at an adjustable flow rate, to bring it to the vaporization pressure and to send it into the oxygen vaporization passages of the heat exchange line; and a liquid air storage receptacle connected upstream of the air liquefaction passages of the heat exchange line and, downstream, and via adjustable flow rate expansion means, to the distillation apparatus, is characterized in that the oxygen storage receptacle is under a pressure adjacent atmospheric pressure, while the liquid air storage receptacle is under a pressure substantially greater than the highest operating pressure of the distillation apparatus.

According to other characteristics of the installation:

—the liquid air storage receptacle is connected to said air liquefaction passages by means of an expansion valve;

—the compression means comprise a principal air compressor followed by a blower adapted to supercharge a fraction of the air not destined for the liquid air storage receptacle.

Figure 2:
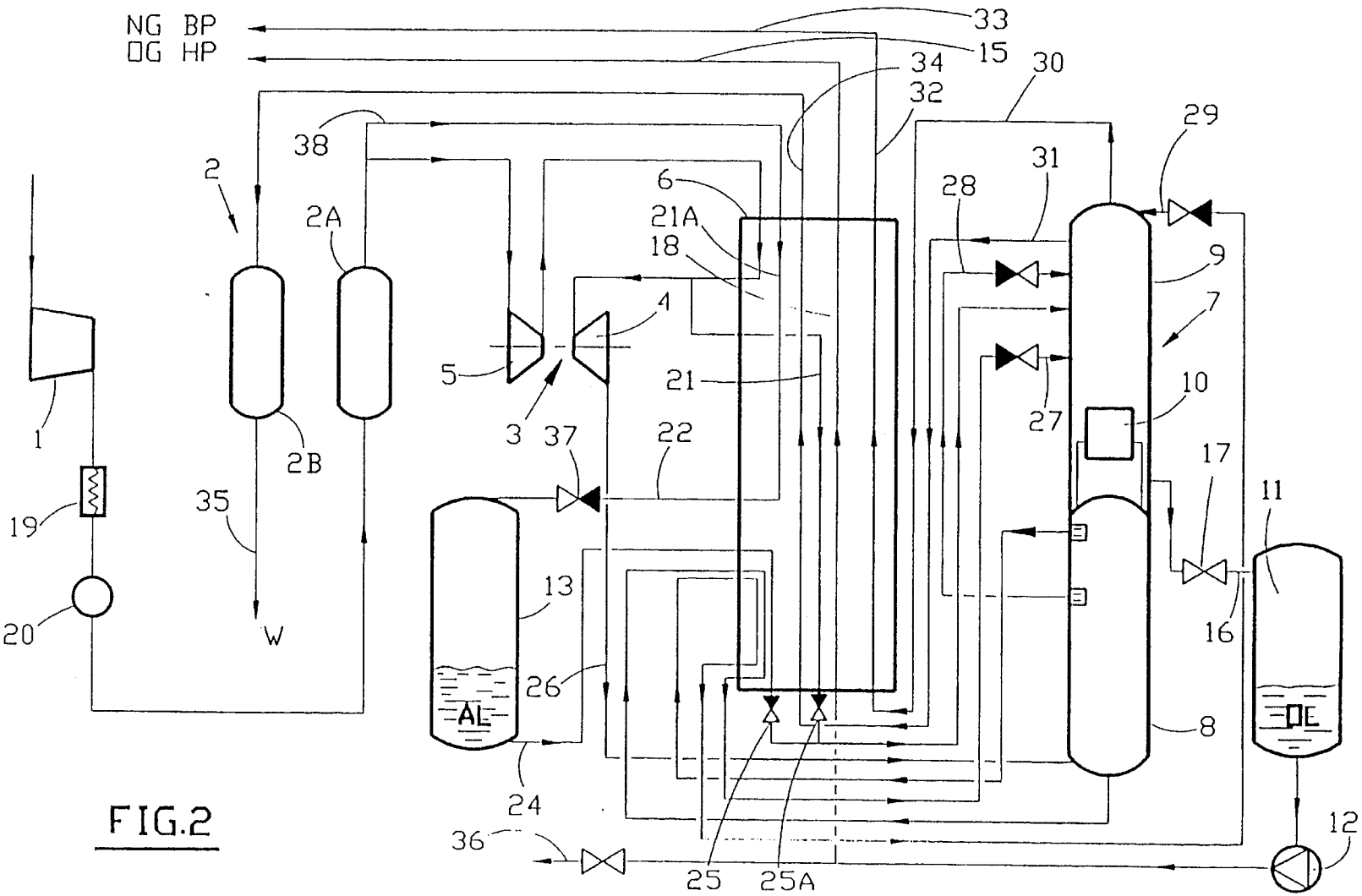

Examples of operation of the invention will now be described with respect to the accompanying drawings, in which:

FIG. 1 shows schematically an installation for the production of gaseous oxygen trader pressure at variable flow rate according to the invention; and FIG. 2 is an analogous view of a modification.

The air distillation installation shown in FIG. 1 comprises essentially: an air compressor 1; an apparatus 2 for the purification of the compressed air from water and $CO_2$ by adsorption, this apparatus comprising two adsorption cylinders 2A, 2B of which one operates in adsorption while the other is in the course of regeneration; a turbine-blower assembly 3 comprising an expansion turbine 4 and a blower or supercharger 5 whose shafts are coupled, the blower being if desired provided with a cooler (not shown); a heat exchanger 6 constituting the heat exchange line of the installation; a double distillation column 7 comprising a medium pressure column 8 surmounted by a low pressure column 9, with a vaporizer-condenser 10 placing the vapor (nitrogen) at the head of column 8 in heat exchange relation with the liquid (oxygen) at the base of column 9; a liquid oxygen reservoir 11 whose bottom is connected to a liquid oxygen pump 12; and a liquid air reservoir 13.

This installation is principally adapted to supply, via a conduit 15, gaseous oxygen under a high predetermined pressure, which could be comprised between about 13 bars and several tens of bars.

To do that, liquid oxygen, withdrawn from the base of column 9 via a conduit 16 provided with a valve 17 for the regulation of the level of the liquid in the base of column 9, is stored in reservoir 11. Liquid oxygen withdrawn from this reservoir is brought to the high vaporization pressure by the pump 12 in liquid phase, then vaporized and reheated under this high pressure in the passages 18 of the heat exchange line 6.

The heat necessary for this vaporization and this reheating, as well as for the reheating and if desired the vaporization of other fluids withdrawn from the double column, is supplied by the air to be distilled, under the following conditions.

All the air to be distilled is compressed by the compressor 1 to a pressure higher than the medium pressure of the column 8 but lower than the high pressure. Then the air, precooled to adjacent ambient temperature in 19 and cooled to a temperature comprised between +5° C. and +25° C. in 20, is purified in one, 2A for example, of the adsorption cylinders, and all of it is supercharged to the high pressure by the supercharger 5, which is driven by the turbine 4.

The air is then introduced into the warm end of exchanger 6 and all of it is cooled to an intermediate temperature. At this temperature, a fraction of the air continues its cooling and is liquefied in the passages 21 of the exchanger, then is withdrawn from the heat exchange line and sent to the reservoir 13 via a conduit 22.

Liquid air withdrawn from this reservoir 13 via a conduit 24 is subcooled in the cold portion of the heat exchange line 6, then is expanded to the low pressure in an expansion valve 25 of adjustable aperture and introduced at an intermediate level into the column 9. As a modification, a portion of the liquid air can be expanded to the medium pressure and introduced into the column 8.

The rest of the air supercharged in 5 is expanded to the medium pressure in the turbine 4 and then sent directly, via a conduit 26, to the base of the column 8.

There will be noted moreover in FIG. 1 the conventional conduits of double column installations, the one shown being of the "minaret" type, which is say with the production of nitrogen under low pressure: the conduits 27–29 being for the injection into the column 9, at increasingly high levels, of expanded "rich liquid" (air enriched in oxygen), of expanded "lower poor liquid" (impure nitrogen) and expanded "upper poor liquid" (practically pure nitrogen), respectively, these three fluids being respectively withdrawn from the base, at an intermediate point and at the top of the column 8; and the conduits 30 for withdrawal of gaseous nitrogen from the top of column 9, and 31 for the evacuation of residual gas (impure nitrogen) from the level of injection of the lower poor liquid. The low pressure nitrogen is reheated in the passages 32 of exchanger 6, then evacuated via a conduit 33, while the residual gas W, after reheating in the passages 34 of the exchanger, is used to regenerate an adsorption cylinder, the cylinder 2B in the example in question, before being evacuated via a conduit 35.

There is also shown in FIG. 1 a conduit 36 for the evacuation of liquid oxygen from the installation, branched from the output conduit of the pump 12.

The high air pressure, at the output of the blower, is comprised between about 25 bars and the condensation pressure of the air by vaporization of oxygen under the high oxygen pressure. As explained in other patent applications which disclose "pumped" processes and "offset phase change isotherms", which is to say in which, as in the present invention, the air which gives the heat of vaporization to the oxygen condenses below the vaporization temperature of this oxygen, the cold balance of the installation is equilibrated, with a temperature difference at the warm end of the heat exchange line of the order of 3° C., by withdrawing from the installation at least one product, here oxygen, in liquid phase, via the conduit 36.

In nominal operation, the level of the liquid in the reservoir 13 is constant, as well as that in the reservoir 11.

When the demand for gaseous oxygen under pressure, in the production conduit 15, varies, the flow of air compressed by the compressor 1 is maintained constant, as well as the output pressure of the compressor, and one proceeds in the following manner.

When the demand for gaseous oxygen decreases, the opening of the valve 25 is increased, so as to increase the quantity of liquid in the column 9. To maintain the liquid level in the base of this column, the valve 17 opens, whereby an increased flow of liquid oxygen is sent to the reservoir 11.

The liquid air contained in the reservoir 13 being at high pressure, its latent heat of liquefaction is low, such that the supplemental flow rate of liquid air sent to the column 9 is substantially greater than the supplemental flow rate of oxygen which is withdrawn from this latter. It is all the greater as the pressure of the liquid air is higher. As a result, the quantity of cold gas produced by the double column and sent to the heat exchange line increases, thereby compensating the reduction of the quantity of cold sent to this latter because of the decrease in demand for gaseous oxygen and, as a result, of the flow rate of oxygen vaporized in the passages 18, this fall being obtained by reducing the speed of the pump 12.

As a result, the level of liquid rises in the reservoir 11, and falls in this reservoir 13.

It is to be noted that the addition of supplemental liquid air requires an increase in the distillation power of the double column 7, which is obtained thanks to the fact that the decrease in the flow rate of liquid oxygen vaporized in 6 gives rise to an increase in the gaseous flow rate introduced into the column 8.

Conversely, during an increase of gaseous oxygen demand, the opening of the valve 25 is reduced, which reduces the flow of liquid air sent to the column 9, the valve 17 closes, and the speed of the pump 12 is increased. Thus, the level of liquid falls in the reservoir 11 and increases in the reservoir 13.

For reasons analogous to what has been explained above, this has for a result a fall in the quantity of cold gas sent to the heat exchange line, this fall compensating in large measure the increase in the quantity of cold introduced into this latter because of the supplemental flow rate of liquid oxygen to be vaporized.

It will be understood that it is preferable to store liquid air in 13 at the highest pressure possible, to amplify the phenomena explained above. However, for technological reasons or because the high pressure is supercritical, the liquid air, as a modification, can be expanded in an expansion valve 37 provided in the conduit 22, before being introduced into the reservoir 13, to an intermediate pressure between the high air pressure and the medium pressure of the column 8.

In the case in which the liquid air is stored at an intermediate pressure, it is interesting, from the energy standpoint, not to compress to the high pressure the air destined for storage receptacle 13. Thus, in the modification of FIG. 2, this air is brought from the outlet of the apparatus 2 via a conduit 38, cooled and liquefied in supplemental passages 21A of the heat exchange line, and sent as before to the receptacle 13 via the conduit 22.

The liquefaction passages 21 of the air under the high pressure are provided, at the cold end of the heat exchange line, with an expansion valve 25A, and the subcooling passages of the liquid air withdrawn from the receptacle 13 are provided, at the stone cold end, with the expansion valve 25.

In this modification, it is the control of the valves 25 and 25A which assures the operation of the air/oxygen swing, analogous moreover to what has been described above with respect to FIG. 1.

The range of optimum pressures, from a thermal equilibrium point of view of the exchange line 6 and of that of the distillation conditions, is comprised between about 30 and 35 bars.

What is claimed is:

1. In a process for the production of gaseous oxygen under pressure at a variable flow rate, in which air is distilled in an air distillation installation comprising a distillation apparatus and a heat exchange line to cool air by heat exchange with products from the distillation apparatus; liquid oxygen is withdrawn from this apparatus, brought to a vaporization pressure, vaporized and reheated under this pressure in the heat exchange line, this vaporization and this reheating being accompanied by a liquefaction of air in the air liquefaction passages of the heat exchange line; and in which:

during a reduction of the demand for gaseous oxygen under pressure, relative to the nominal flow rate, excess oxygen produced by the distillation apparatus is withdrawn from this apparatus, in liquid phase, sent to a receptacle for the storage of liquid oxygen, and there is introduced into the distillation apparatus a previously stored corresponding additional quantity of liquid air; and during an increase in the demand for gaseous oxygen under pressure, relative to the nominal flow rate, the required excess oxygen is withdrawn, in liquid phase, from the liquid oxygen storage receptacle brought to the vaporization pressure, and vaporized under this pressure in the heat exchange line, and there is stored a corresponding quantity of air liquefied by said vaporization, in the liquid air storage receptacle;

the improvement comprising storing the liquid oxygen under about atmospheric pressure, and storing the liquid air under a storage pressure substantially greater than the highest operating pressure of the distillation apparatus.

2. Process according to claim 1, wherein the liquid air storage receptacle is at about the pressure at which said liquefaction of air takes place.

3. Process according to claim 1, wherein the liquid air storage receptacle is at a pressure between about 30 and 35 bars.

4. Process according to claim 1, wherein all the vaporized oxygen is withdrawn from the liquid oxygen storage receptacle.

5. Process according to claim 1, wherein said liquefaction of air is carried out at a temperature lower than the vaporization temperature of the oxygen under said vaporization pressure, and at least one liquid product is evacuated from the installation.

6. Process according to claim 1, comprising the further steps of withdrawing from storage liquid air at said substantially greater pressure, reducing said substantially greater pressure to an operating pressure of the distillation apparatus, and introducing the material whose pressure is thus reduced into the distillation apparatus.

* * * * *